US006983111B2

(12) United States Patent
Ichikawa et al.

(10) Patent No.: US 6,983,111 B2
(45) Date of Patent: Jan. 3, 2006

(54) IMAGE FORMATION DEVICE AND IMAGE FORMATION METHOD

(75) Inventors: Kazuhiro Ichikawa, Nagano-ken (JP); Osamu Ishibashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/662,874

(22) Filed: Sep. 16, 2003

(65) Prior Publication Data

US 2004/0208662 A1 Oct. 21, 2004

(30) Foreign Application Priority Data

Sep. 17, 2002 (JP) ..... 2002-269931

(51) Int. Cl.
*G03G 15/00* (2006.01)
*G03G 15/01* (2006.01)

(52) U.S. Cl. ..... 399/49; 399/12; 399/53; 399/82

(58) Field of Classification Search ..... 399/49, 399/46, 72, 38, 82, 12, 13, 53; 358/504, 358/406, 296; 347/19, 115, 172, 188

See application file for complete search history.

(56) References Cited

U.S. PATENT DOCUMENTS

| | | | | |
|---|---|---|---|---|
| 6,181,892 | B1 * | 1/2001 | Fujimori | 399/72 |
| 6,192,207 | B1 * | 2/2001 | Yamamoto et al. | 399/82 |
| 6,636,711 | B1 * | 10/2003 | Katahira | 399/82 |
| 6,763,202 | B2 * | 7/2004 | Maeda | 399/53 |
| 2001/0043258 | A1 * | 11/2001 | Ohki | 347/115 |
| 2002/0041770 | A1 * | 4/2002 | Nakazato et al. | 399/49 |

FOREIGN PATENT DOCUMENTS

| | | | |
|---|---|---|---|
| JP | 02-144568 A | * | 6/1990 |
| JP | 2001-094810 A | * | 4/2001 |

* cited by examiner

*Primary Examiner*—Sophia S. Chen
(74) *Attorney, Agent, or Firm*—Sughrue Mion, PLLC

(57) ABSTRACT

The process of the invention determines whether the value of a color mode CMode represents a color image formation mode or a monochromatic image formation mode (S200, S210). The process forms test toner images of cyan, magenta, yellow, and black in the case of the color image formation mode (S220), while forming a test toner image of only black in the case of the monochromatic image formation mode (S230). The process detects a toner density of each test toner image formed with a toner density sensor (S240), and sets control parameters used for controlling toner image formation, based on the detected toner densities (S250).

13 Claims, 8 Drawing Sheets

IMAGE FORMATION DEVICE AND IMAGE FORMATION METHOD

BACKGROUND OF THE INVENTION

1. Field of the Invention

The present invention relates to an image formation device and an image formation method. More specifically, the invention relates to an image formation device that transfers toner images formed with toners of multiple colors onto a recording medium, such as paper, so as to form a color image, and a corresponding image formation method.

2. Description of the Prior Art

As is known in the art, a conventional image formation device that is capable of forming a color image, such as a color laser printer or a color photocopier, develops electrostatic latent images of respective colors formed on a photoreceptor as toner images with toners of respective colors, transfers the toner images of the respective colors in an overlapping manner as a composite color toner image on an intermediate transfer medium, such as a transfer belt, and transfers and fixes the composite color toner image as a resulting color image on a recording medium like paper. The toner density of each toner image formed on the photoreceptor or the intermediate transfer medium is varied with a variation in working environment, for example, the temperature or the humidity. The image formation device accordingly carries out adjustment of a toner image formation process according to the working environment.

A variation in toner density of the toner image less affects the picture quality of a resulting monochromatic image, compared with that of a resulting color image. The prior art image formation device, however, adopts the same procedure for adjustment of the toner image formation process in the case of formation of a monochromatic image and in the case of formation of a color image. Such adjustment applies unnecessary, excessive loads onto the respective constituents of the image formation device and thereby accelerates deterioration of the constituents.

SUMMARY OF THE INVENTION

An image formation device and a corresponding image formation method of the present invention aim to adjust the toner density adequately for formation of the composite color image or formation of the monochromatic image. The image formation device and the corresponding method of the invention also aim to effectively prevent excessive deterioration of constituents of the image formation device.

In order to achieve at least a part of the aforementioned aim, the image formation device is constructed as follows.

An image formation device of the present invention is a device that transfers toner images formed with toners of multiple colors onto a recording medium, such as paper, so as to form a color image, the image formation device comprising: a specification module that specifies either formation of a composite color image or formation of a monochromatic image; and a control module that, when the specification module specifies formation of the composite color image, controls to selectively apply a color image adjustment operation for toner density adjustment that adjusts a toner density of each toner image formed, while controlling to selectively apply a monochromatic image adjustment operation for the toner density adjustment when the specification module specifies formation of the monochromatic image.

The image formation device of the invention specifies either formation of a composite color image or formation of a monochromatic image and controls the toner density adjustment to be suitable for formation of the composite color image or for formation of the monochromatic image, based on the result of the specification. This arrangement ensures the adequate toner density adjustment for formation of the composite color image or formation of the monochromatic image, thus effectively preventing excessive deterioration of constituents of the image formation device involved in the toner density adjustment. The formation of the composite color image or the formation of the monochromatic image may be specified, based on external information like printing instruction information and image data input from a computer connecting with the image formation device or input through operations of an operation panel of the image formation device or based on internal information like setting information of the image formation device.

The image formation device of the invention, as one modified structure, may further include an information acquisition module that acquires information on color of toner filled in each toner cartridge from each of storage elements mounted on multiple toner cartridges, which are attached to the image formation device. In this modified structure, the specification module may specify formation of the composite color image or formation of the monochromatic image, based on the information on the color of toner acquired by the information acquisition module. In the modified structure, further, the composite color image may be formed with toners of at least three primary colors, cyan, magenta, and yellow, and the specification module may specify formation of the composite color image when the colors of toners filled in the multiple toner cartridges include all of the three primary colors, while specifying formation of the monochromatic image when the colors of toners filled in the multiple toner cartridges exclude at least one of the three primary colors. In the modified structure, still further, the specification module may specify formation of the composite color image when the colors of toners filled in the multiple toner cartridges include any color other than black, while specifying formation of the monochromatic image when the colors of toners filled in the multiple toner cartridges are all black.

In the image formation device of the present invention, the toner density adjustment may detect a toner density of a test toner image formed and set a control parameter for controlling toner image formation based on the detected toner density, the color image adjustment operation may detect toner densities of multiple test toner images formed with multiple color toners and set the control parameter, and the monochromatic image adjustment operation may detect a toner density of a test toner image formed with black toner and set the control parameter. The color image adjustment operation may detect a toner density of a test toner image formed and set a control parameter for controlling toner image formation based on the detected toner density, and the monochromatic image adjustment operation may set a preset monochromatic image parameter value to the control parameter. Here, the toner density adjustment for formation of the monochromatic image may detect the toner density of only one test toner image formed with black toner or may set a predetermined parameter value to the control parameter without detection of the toner density of a test toner image. This is because a variation in toner density less affects the picture quality of a resulting monochromatic image, compared with that of a resulting color image. The control parameter may include at least one of a charge potential of a photoreceptor, a light exposure of an exposure unit, a developing bias of a developer unit, and a charge potential of a transfer unit.

The technique of the present invention is not restricted to the image formation device described above, but is also applicable to an image formation method.

DESCRIPTION OF THE PREFERRED EMBODIMENTS

Figure 1:
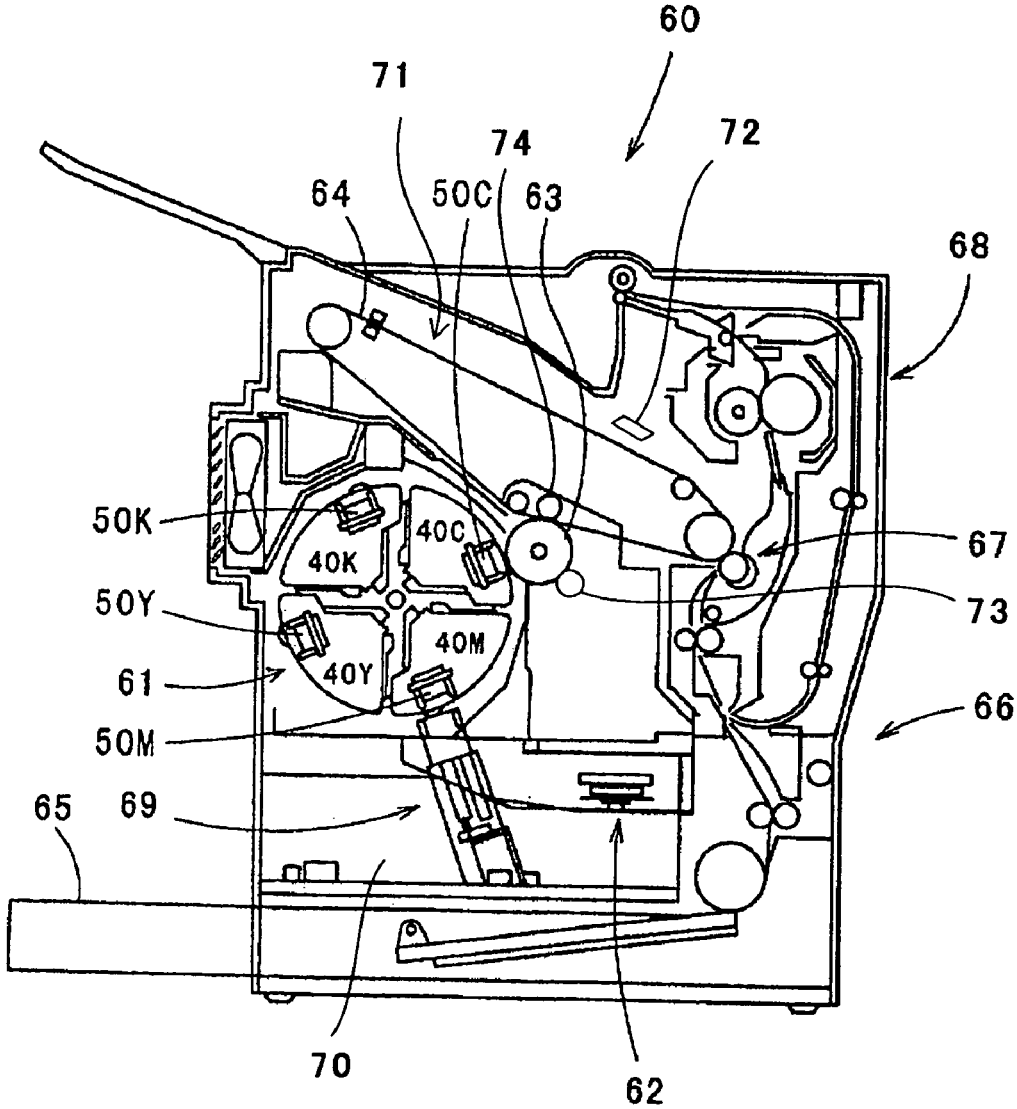
FIG. 1 schematically illustrates the structure of a color laser printer 60 in one embodiment.

One preferred embodiment of the invention is discussed below. FIG. 1 schematically illustrates the structure of a color laser printer 60 functioning as an image formation device in one embodiment of the invention. The color laser printer 60 of the embodiment is constructed as a full-color electrophotographic image formation device that adopts a single photoreceptor system and an intermediate transfer system. As illustrated, the color laser printer 60 includes a charge roller 73 that charges a photoreceptor 63 to a fixed potential (for example, −700 V), an exposure unit 62 that irradiates the charged photoreceptor 63 with laser and thereby forms color-separated images of four colors, cyan (C), magenta (M), yellow (Y), and black (K), as electrostatic latent images on the photoreceptor 63, and a developer unit 61 that develops the electrostatic latent images formed on the photoreceptor 63 as toner images of the respective colors with corresponding color toners respectively fed from toner cartridges 40C, 40M, 40Y, and 40K attached to the developer unit 61. The color laser printer 60 further includes a primary transfer unit 71 that transfers the toner images of the respective colors developed on the photoreceptor 63 onto a transfer belt 64 in an overlapping manner to form a composite color toner image, a feeder unit 66 that conveys printing paper from a paper cassette 65, a secondary transfer unit 67 that further transfers the composite color toner image formed on the transfer belt 64 onto the conveyed printing paper, a fixation unit 68 that fixes the transferred composite color toner image on the printing paper and delivers the printing paper with the fixed composite color toner image, and a controller 70 that controls all the operations of the color laser printer 60.

Figure 2:
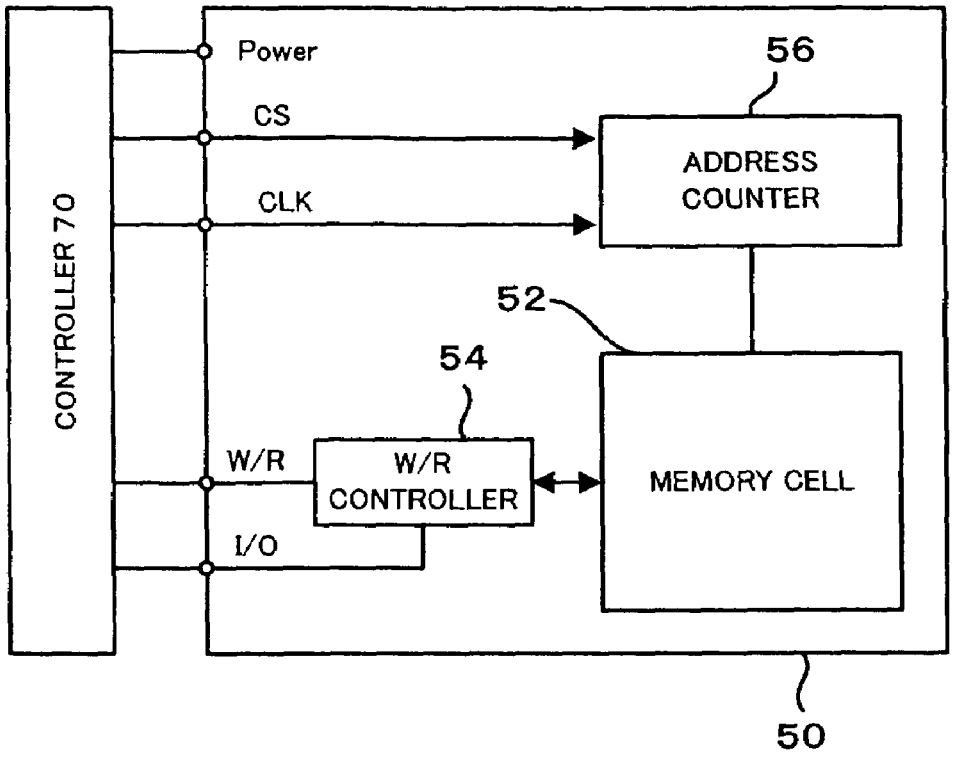
FIG. 2 shows the electrical connection of the controller 70 with each of the storage elements 50.

The developer unit 61 is rotatable to make each of the toner cartridges 40C, 40M, 40Y, and 40K attached to the developer unit 61 face the photoreceptor 63. The toner cartridges 40C, 40M, 40Y, and 40K respectively have storage elements 50C, 50M, 50Y, and 50K. The controller 70 reads information on the color of toner filled in each toner cartridge via a movable connector 69, which connects with each of the storage elements 50 moved to be located at a lower right position in the drawing. FIG. 2 shows the electrical connection of the controller 70 with each of the storage elements 50. As illustrated, the storage element 50 includes a memory cell 52 that stores data, a read-write controller 54 that controls operations of reading and writing data from and into the memory cell 52, and an address counter 56 that counts up in the process of data transmission to and from the controller 70 of the color laser printer 60 via the read-write controller 54 in response to a clock signal CLK. An EEPROM is a typical example of the storage element 50.

The primary transfer unit 71 has a transfer roller 74 that rotates while holding the transfer belt 64 interposed between the photoreceptor 63 and the transfer roller 74 and pressing the transfer belt 64 against the photoreceptor 63. The function of the transfer roller 74 charges the transfer belt 64 to a reverse polarity to the polarity of a toner image formed on the photoreceptor 63, and thereby causes the toner image to be transferred to the transfer belt 64 by the function of an electric field and the pressing force. The primary transfer unit 71 also has a toner density sensor 72 that irradiates the toner image transferred to the transfer belt 64 with infrared light and detects a toner density of the toner image, based on an observed quantity of reflected light. The detected toner density is input into the controller 70 via a signal line and an input port (not shown).

Figure 3:
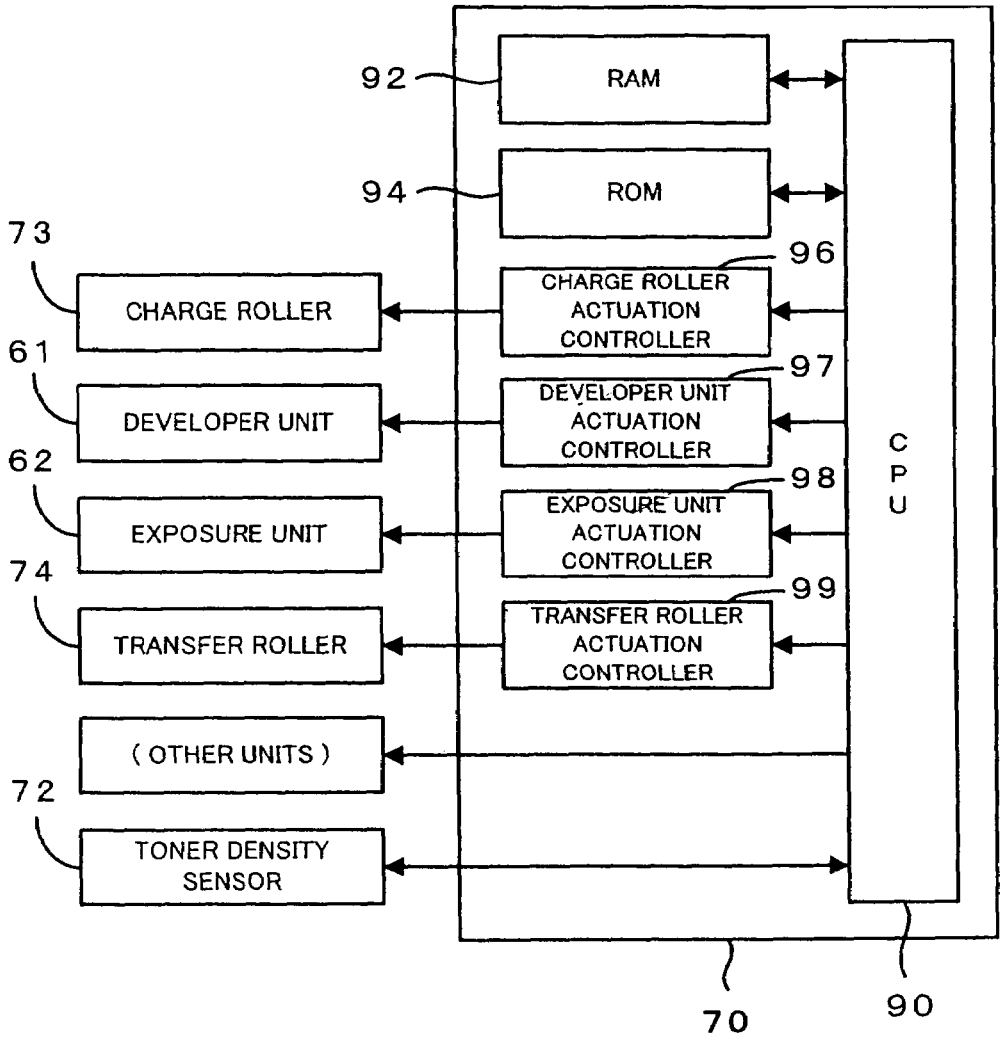
FIG. 3 is a block diagram showing functional blocks of the controller 70.

FIG. 3 is a block diagram showing functional blocks of the controller 70. As illustrated, the controller 70 is constructed as a microprocessor including a CPU 90, a RAM 92, and a ROM 94. The controller 70 receives the toner density detected by the toner density sensor 72 and other input signals (for example, a print instruction signal given by an operator) via signal lines. The controller 70 controls the operations of the respective constituents of the color laser printer 60 and specifically regulates a charge potential applied on the charge roller 73, a developing bias potential applied on the developer unit 61, a light exposure of the exposure unit 62, and a charge potential applied on the transfer roller 74 via a charge roller actuation controller 96, a developer unit actuation controller 97, an exposure unit actuation controller 98, and a transfer roller actuation controller 99, based on the input signals. The charge roller 73, the exposure unit 62, the feeder unit 66, and the secondary transfer unit 67 are identical with those included in conventional color laser printers and color photocopiers and are not specifically described here.

Figure 4:
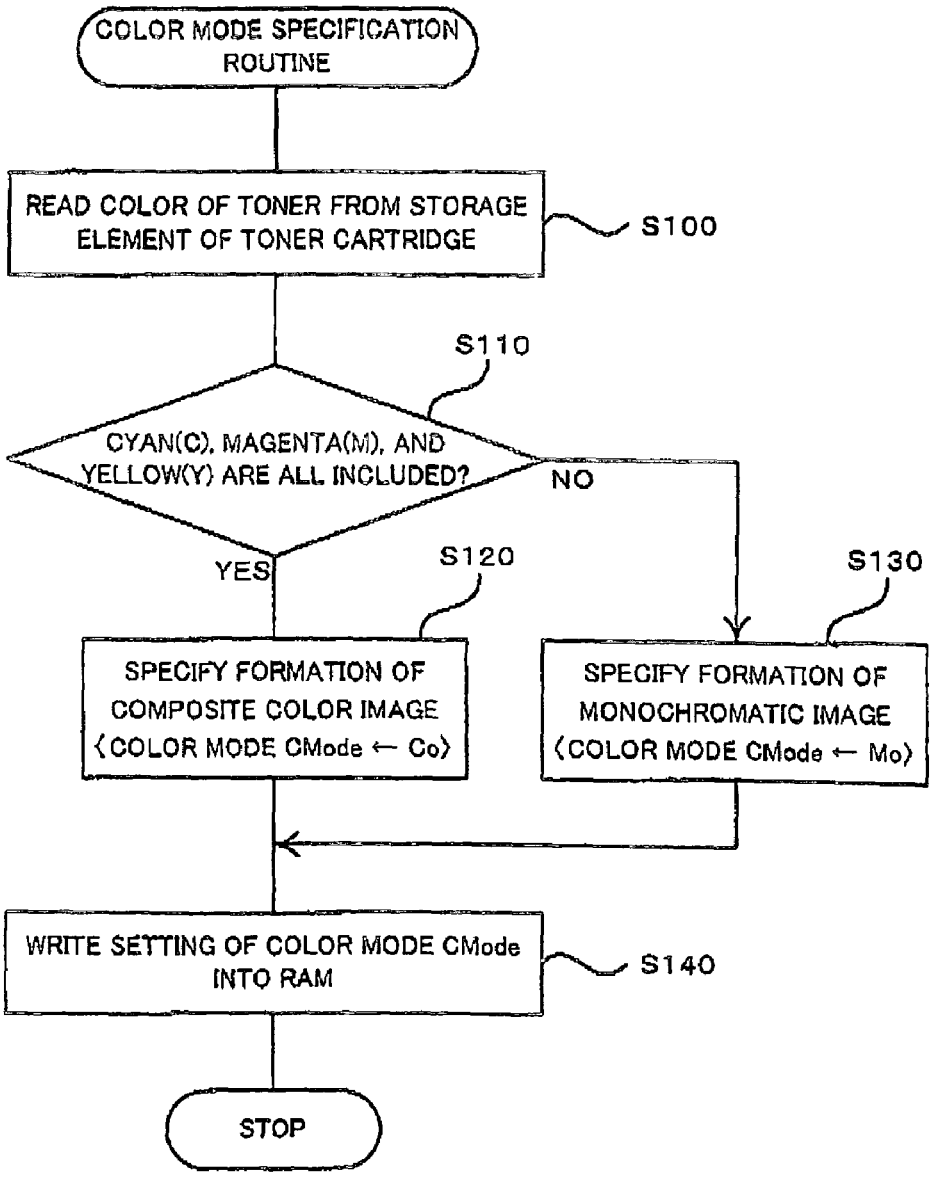
FIG. 4 is a flowchart showing a color mode specification routine.

The following describes operations of the color laser printer 60 in the embodiment and specifically an operation of regulating the toner density of each toner image formed. FIG. 4 is a flowchart showing a color mode specification routine, which is executed by the controller 70 in response to a power ON operation of the color laser printer 60 or in response to attachment of the toner cartridge 40 to the color laser printer 60. The color mode specification routine sets a color mode CMode, one of control parameters used for controlling toner density adjustment discussed later. When the color mode specification routine starts, the controller 70 first reads color information of the toner filled in the toner cartridge 40 from the storage element 50 of the toner cartridge 40 attached to the color laser printer 60 (step S100). According to a concrete procedure, the controller 70 outputs a read signal to the read-write controller 54 of the storage element 50 of the toner cartridge 40 connecting with the movable connector 69 of the color laser printer 60.

The controller 70 subsequently determines whether toners of cyan (C), magenta (M), and yellow (Y) are all included in the toner filled in the toner cartridge 40 attached to the color laser printer 60, based on the read-out color information of the toner (step S110). When the toners of all these colors are included in the toner cartridge 40, the controller 70 specifies formation of a composite color image, sets a value Co (representing a color image formation mode) to the color mode CMode, and writes the setting of the color mode CMode at a preset address in the RAM 92 (steps S120 and S140). When the toners of all these colors are not included in the toner cartridge 40, that is, when any of the toners of cyan (C), magenta (M), and yellow (Y) is absent, on the other hand, the controller 70 specifies formation of a monochromatic image, sets a value Mo (representing a monochromatic image formation mode) to the color mode CMode, and writes the setting of the color mode CMode at the preset address in the RAM 92 (steps S130 and S140). After the processing, the color mode specification routine is terminated.

Figure 5:
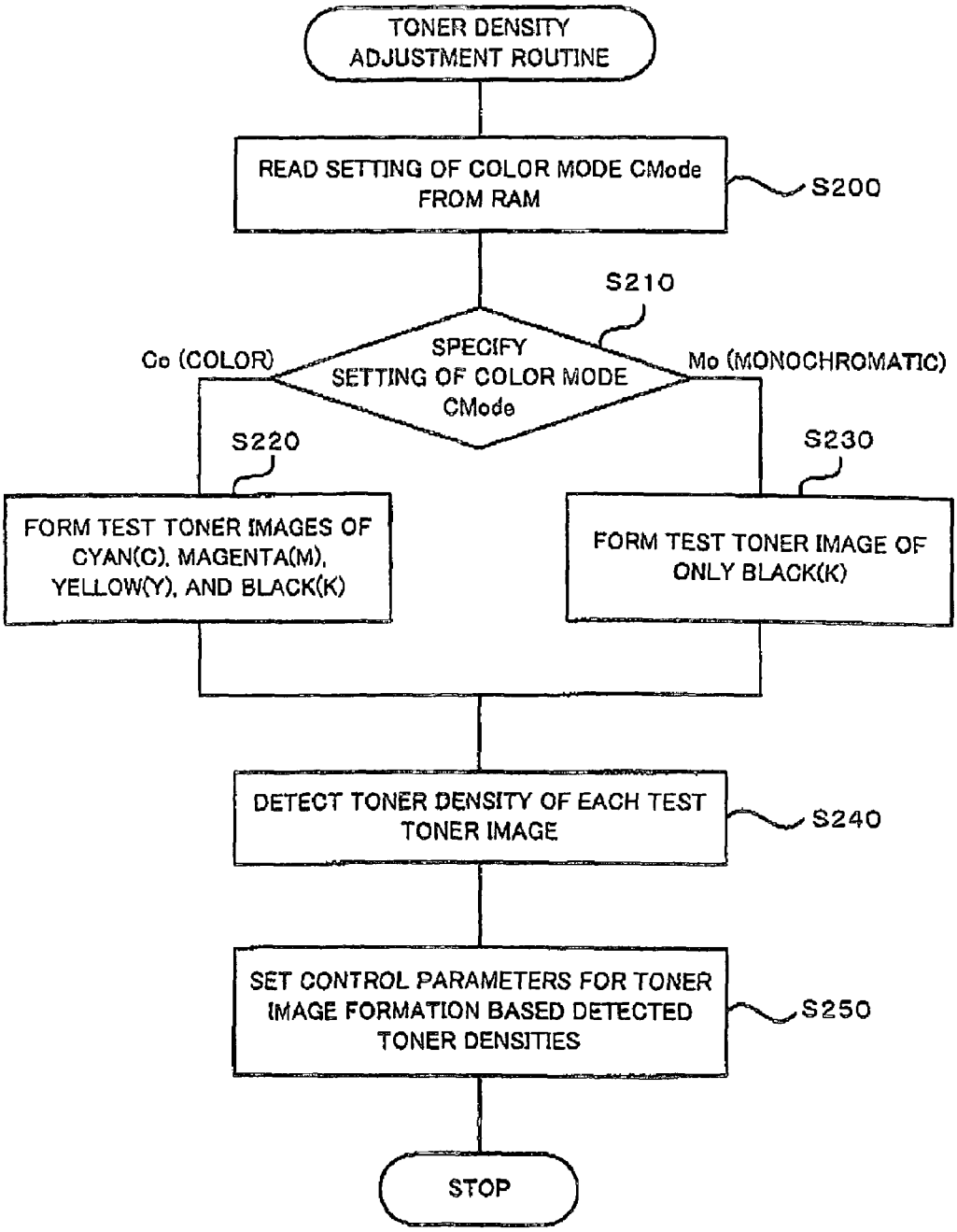
FIG. 5 is a flowchart showing a toner density adjustment routine.

The following describes a toner density adjustment process to adjust the toner density of each toner image formed. FIG. 5 is a flowchart showing a toner density adjustment routine. The toner density adjustment routine is executed by the controller 70, when the color mode specification routine executed in response to the power ON operation of the color laser printer 60 is concluded or when the number of printed images reaches a preset value after a previous cycle of the toner density adjustment routine. When the toner density adjustment routine starts, the controller 70 first reads the setting of the color mode CMode from the RAM 92 (step S200) and specifies the setting of the color mode CMode as either the value Co (the color image formation mode) or the value Mo (the monochromatic image formation mode) (step S210). The value of the color mode CMode has been set in advance according to the color mode specification routine discussed above.

Figure 6:
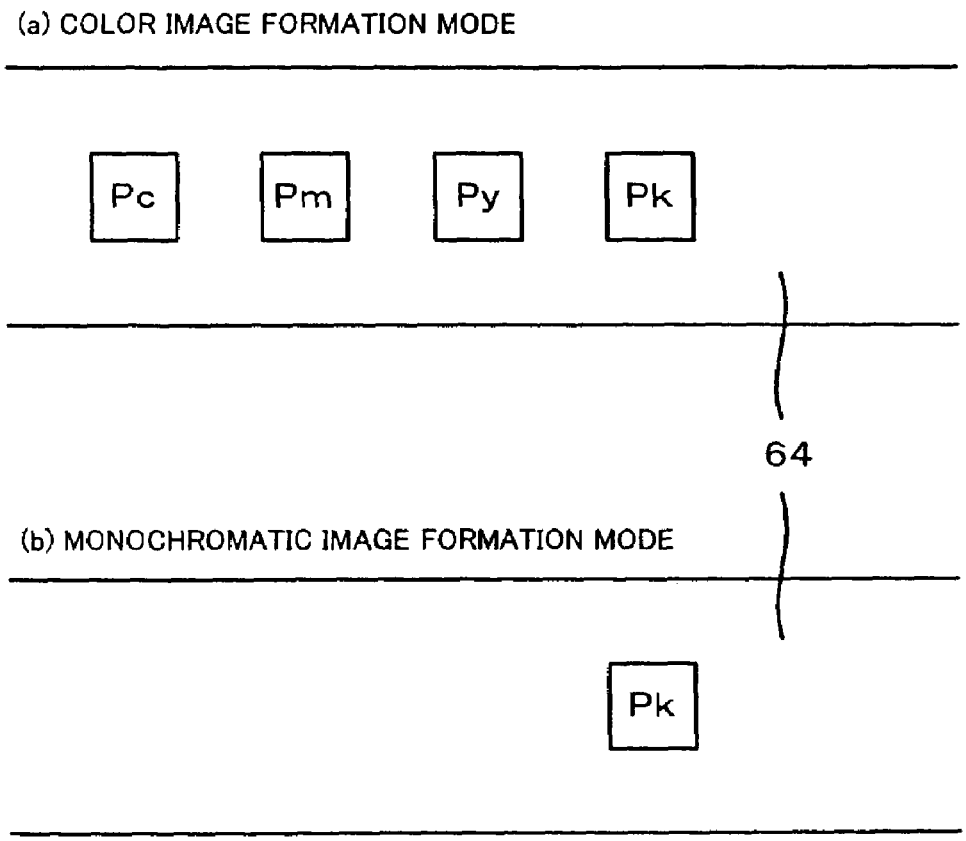
FIG. 6 shows one example of the patch toner images.

When the setting of the color mode CMode is the value Co (the color image formation mode), the controller 70 uses all the toners of cyan (C), magenta (M), yellow (Y), and black (K) to form test toner images or patch toner images Pc, Pm, Py, and Pk on the transfer belt 64 (step S220). When the setting of the color mode CMode is the value M (the monochromatic image formation mode), on the other hand, the controller 70 uses only the toner of black (K) to form only a patch toner image Pk on the transfer belt 64 (step S230). The procedure of the embodiment reads image data, which correspond to the respective patch toner images and are stored in advance in the ROM 94, forms the electrostatic latent images on the photoreceptor 63, develops the electrostatic latent images with the developer unit 61, and transfers the developed patch toner images onto the transfer belt 64. FIG. 6 shows one example of the patch toner images formed on the transfer belt 64. As illustrated, when the setting of the color mode is the color image formation mode, the patch toner images of the respective colors are successively formed at preset intervals. When the setting of the color mode is the monochromatic image formation mode, only the patch toner image of black (K) is formed. In the color image formation mode, four cycles of toner image formation are required to implement the processing from the formation of the electrostatic latent images on the photoreceptor 63 to the transfer of the patch toner images onto the transfer belt 64. In the monochromatic image formation mode, on the other hand, only one cycle of toner image formation is sufficient.

Figure 7:
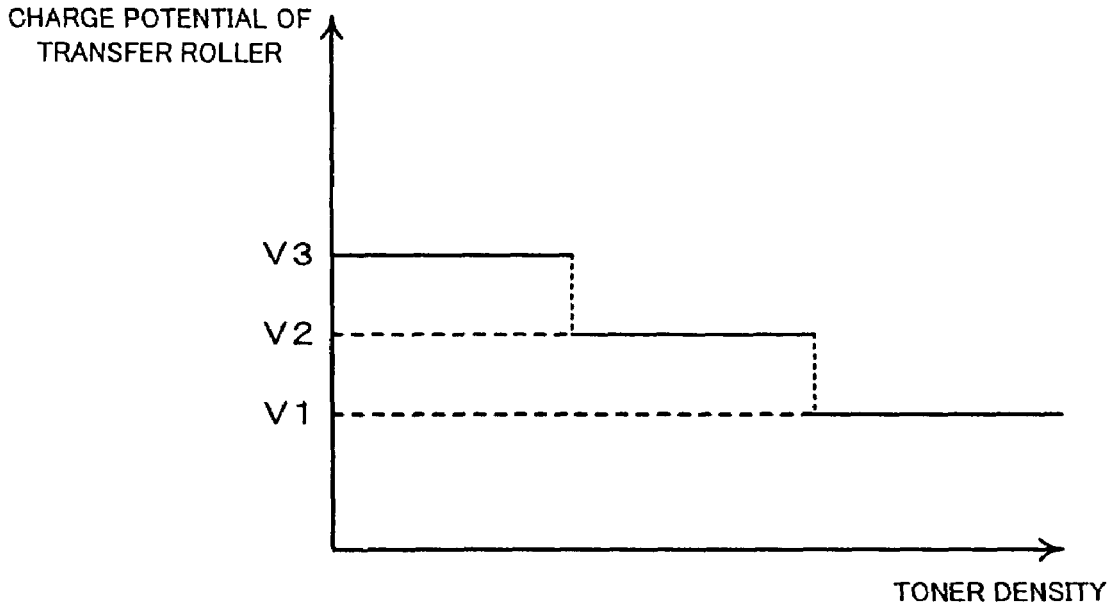
FIG. 7 shows a map of setting the control parameters.

After formation of the patch toner images, the controller 70 detects the toner density of each patch toner image formed with the toner density sensor 72 (step S240). The controller 70 then sets control parameters (for example, the charge potential of the photoreceptor 63, the light exposure of the exposure unit 62, the developing bias of the developer unit 61, and the transfer potential of the transfer roller 74) used for controlling the operations of the respective constituents involved in formation of the toner images, based on the detected toner densities and writes the settings of the control parameters into the RAM 92 (step S250). After the processing, the toner density adjustment routine is terminated. The procedure of this embodiment experimentally or otherwise specifies relations between the detected toner density and the settings of the control parameters and stores in advance the relations in the form of control parameter setting maps into the ROM 94. The settings of the control parameters corresponding to the detected toner density are read from the control parameter setting maps. One example of the control parameter setting maps is given as FIG. 7. FIG. 7 shows a map of settings for the charge potential of the transfer roller 74, where voltage 1 (V1), voltage 2 (V2), and voltage 3 (V3) are an example of various charge potentials for the transfer roller 74. Similar maps are given to set the other control parameters, that is, the charge potential of the photoreceptor 63, the light exposure of the exposure unit 62, and the developing bias of the developer unit 61. The toner images are formed with the settings of the control parameters written in the RAM 92, in response to the operator's print instruction. The arrangement of the embodiment ensures formation of the toner images having the adequate toner densities, regardless of a variation in working environment, for example, the temperature or the humidity.

As described above, the color laser printer 60 of the embodiment reads the color of toner filled in the toner cartridge 40 from the storage element 50 of the toner cartridge 40, specifies either formation of a composite color image or formation of a monochromatic image, sets the control parameters for the toner density adjustment according to the result of the specification, and carries out the toner density adjustment process with the settings of the control parameters. The arrangement of the embodiment ensures adequate toner density adjustment for formation of the composite color image or for formation of the monochromatic image. This desirably relieves the load on the constituents of the color laser printer 60 involved in the toner density adjustment process and prevents the excessive deterioration of the constituents. The arrangement also ensures easy specification of either formation of the composite color image or formation of the monochromatic image, based on the information on the color of toner read from the storage element 50 of the toner cartridge 40.

The movable connector 69 included in the color laser printer 60 of the embodiment corresponds to the information acquisition module of the invention. The controller 70 executing the color mode specification process and the toner density adjustment process corresponds to the specification module and the control module of the invention.

Figure 8:
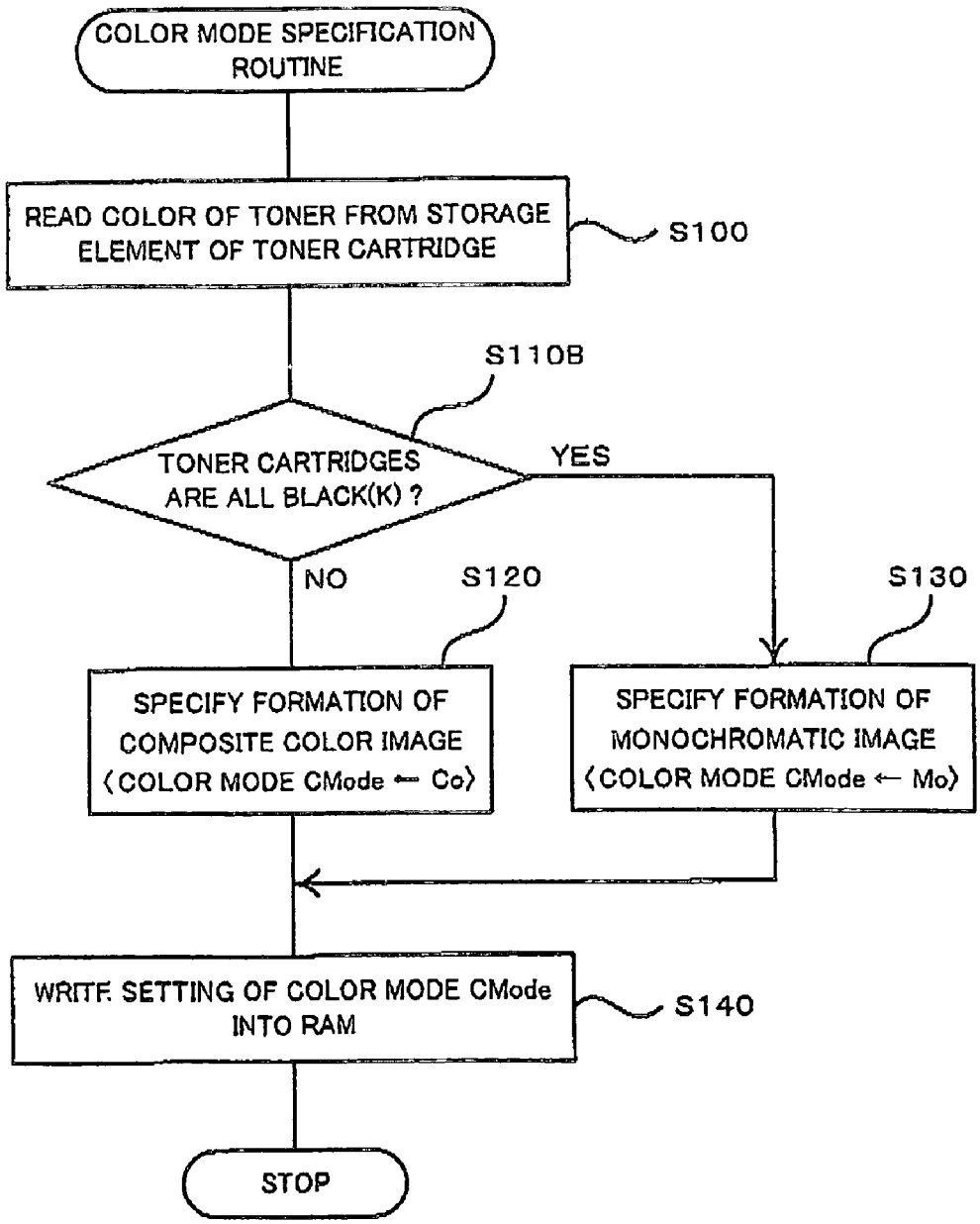
FIG. 8 is a flowchart showing a color mode specification routine.

The color laser printer 60 of the embodiment determines whether the toners of cyan (C), magenta (M), and yellow (Y) are all included in the toner filled in the toner cartridge 40 attached to the color laser printer 60, based on the color information of the toner read from the storage element 50 of the toner cartridge 40, and specifies either formation of a composite color image or formation of a monochromatic image. Another method may alternatively be applied to specify formation of the composite color image or formation of the monochromatic image, as long as the specification is based on the read-out color information of the toner. One modified procedure may specify formation of a composite color image when the toner of any color other than black (K) is included in the toner filled in the toner cartridge 40 attached to the color laser printer 60, while specifying formation of a monochromatic image when only the toner of black (K) (step S110B) is included, as shown in FIG. 8.

In the monochromatic image formation mode, the color laser printer 60 of the embodiment detects the toner density of the formed patch toner image of black (K) and sets the control parameters of the toner image formation, based on the detected toner density. One possible modification may set the control parameters without detection of the toner density of the patch toner image. Namely this modified procedure sets predetermined values to the control parameters in the monochromatic image formation mode.

In the color printer 60 of the embodiment, the control parameters of the toner image formation to be set are the charge potential of the photoreceptor 63, the light exposure of the exposure unit 62, the developing bias of the developer unit 61, and the transfer potential of the transfer roller 74. The control parameters are however, not restricted to this example but may be any parameters affecting the toner density of each toner image formed.

The color laser printer 60 of the embodiment reads the color of the toner from the storage element 50 of the toner cartridge 40 and specifies formation of a composite color image or formation of a monochromatic image. Another method may be applied to specify formation of the composite color image or formation of the monochromatic image. For example, specification of either formation of a composite color image or formation of a monochromatic image may be based on printing instruction information or image data input from a computer connecting with the color laser printer 50 or input through operations of an operation panel of the laser printer 60.

The color laser printer 60 of the embodiment is constructed as a full-color electrophotographic image formation device that adopts the single photoreceptor system and the intermediate transfer system. The requirement is simply to read the information on the color of the toner from the storage element 50 of the toner cartridge 40. The technique of the invention is thus also applicable to a color laser printer or a color photocopier constructed as a full-color electrophotographic image formation device that adopts a multiple photoreceptor system or a direct transfer system.

The embodiment regards the color laser printer 60 that fixes toner images transferred with toners of multiple colors onto a recording medium, such as paper, so as to form a color image. The technique of the invention is also actualized by a corresponding image formation method of forming a color image in such a way.

The above embodiment is to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein.

What is claimed is:

1. An image formation device that transfers toner images formed with toners of multiple colors onto a recording medium, so as to form a color image, said image formation device comprising:

a specification module that specifies either formation of a composite color image or formation of a monochromatic image;

a control module that, when said specification module specifies formation of the composite color image, controls to selectively apply a color image adjustment operation for toner density adjustment that adjusts a toner density of each toner image formed, while controlling to selectively apply a monochromatic image adjustment operation for the toner density adjustment when said specification module specifies formation of the monochromatic image; and an information acquisition module that acquires information on color of toner filled in each toner cartridge from each of storage elements mounted on multiple toner cartridges, which are attached to said image formation device, wherein said specification module specifies formation of the composite color image or formation of the monochromatic image, based on the information on the color of toner acquired by said information acquisition module.

2. An image formation device in accordance with claim 1, wherein the composite color image is formed with toners of at least three primary colors, cyan, magenta, and yellow, and said specification module specifies formation of the composite color image when the colors of toners filled in said multiple toner cartridges include all of the three primary colors, while specifying formation of the monochromatic image when the colors of toners filled in said multiple toner cartridges exclude at least one of the three primary colors.

3. An image formation device in accordance with claim 1, wherein said specification module specifies formation of the composite color image when the colors of toners filled in said multiple toner cartridges include any color other than black, while specifying formation of the monochromatic image when the colors of toners filled in said multiple toner cartridges are all black.

4. An image formation device in accordance with claim 1, wherein the toner density adjustment detects a toner density of a test toner image formed and sets a control parameter for controlling toner image formation, based on the detected toner density, the color image adjustment operation detects toner densities of multiple test toner images formed with multiple color toners and sets the control parameter, and the monochromatic image adjustment operation detects a toner density of a test toner image formed with black toner and sets the control parameter.

5. An image formation device in accordance with claim 1, wherein a control parameter includes at least one of a charge potential of a photoreceptor, a light exposure of an exposure unit, a developing bias of a developer unit, and a charge potential of a transfer unit.

6. An image formation device that transfers toner images formed with toners of multiple colors onto a recording medium, so as to form a color image, said image formation device comprising:

a specification module that specifies either formation of a composite color image or formation of a monochromatic image; and a control module that, when said specification module specifies formation of the composite color image, controls to selectively apply a color image adjustment operation for toner density adjustment that adjusts a toner density of each toner image formed, while controlling to selectively apply a monochromatic image adjustment operation for the toner density adjustment when said specification module specifies formation of the monochromatic image;

wherein the color image adjustment operation detects a toner density of a test toner image formed and sets a control parameter for controlling toner image formation, based on the detected toner density, and wherein the monochromatic image adjustment operation sets a preset monochromatic image parameter value to the control parameter.

7. An image formation method that transfers toner images formed with toners of multiple colors onto a recording medium, so as to form a color image, said image formation method comprising:

(a) specifying either formation of a composite color image or formation of a monochromatic image; and (b) controlling to selectively apply a color image adjustment operation for toner density adjustment that adjusts a toner density of each toner image formed when said step(a) specifies formation of the composite color image, while controlling to selectively apply a monochromatic image adjustment operation for the toner density adjustment when said step(a) specifies formation of the monochromatic image;

wherein said step (a) specifies formation of the composite color image or formation of the monochromatic image, based on information on color of toner acquired from each of storage elements mounted on multiple toner cartridges, which are attached to an image formation device.

8. An image formation method in accordance with claim 7, wherein the composite color image is formed with toners of at least three primary colors, cyan, magenta, and yellow, and said step (a) specifies formation of the composite color image when the colors of toners filled in said multiple toner cartridges include all of the three primary colors, while specifying formation of the monochromatic image when the colors of toners filled in said multiple toner cartridges exclude at least one of the three primary colors.

9. An image formation method in accordance with claim 7, wherein said step(a) specifies formation of the composite color image when the colors of toners filled in said multiple toner cartridges include any color other than black, while specifying formation of the monochromatic image when the colors of toners filled in said multiple toner cartridges are all black.

10. An image formation method in accordance with claim 7, wherein the toner density adjustment detects a toner density of a test toner image formed and sets a control parameter for controlling toner image formation, based on the detected toner density, the color image adjustment operation detects toner densities of multiple test toner images formed with multiple color toners and sets the control parameter, and the monochromatic image adjustment operation detects a toner density of a test toner image formed with black toner and sets the control parameter.

11. An image formation method in accordance with claim 7, wherein a control parameter includes at least one of a charge potential of a photoreceptor, a light exposure of an exposure unit, a developing bias of a developer unit, and a charge potential of a transfer unit.

12. An image formation method that transfers toner images formed with toners of multiple colors onto a recording medium, so as to form a color image, said image formation method comprising the steps of:

(a) specifying either formation of a composite color image or formation of a monochromatic image; and (b) controlling to selectively apply a color image adjustment operation for toner density adjustment that adjusts a toner density of each toner image formed when said step(a) specifies formation of the composite color image, while controlling to selectively apply a monochromatic image adjustment operation for the toner density adjustment when said step(a) specifies formation of the monochromatic image;

wherein the color image adjustment operation detects a toner density of a test toner image formed and sets a control parameter for controlling toner image formation, based on the detected toner density, and wherein the monochromatic image adjustment operation sets a preset monochromatic image parameter value to the control parameter.

13. An image formation device that transfers toner images formed with toners of multiple colors onto a recording medium, so as to form a color image, said image formation device comprising:

a specification module that specifies either formation of a composite color image or formation of a monochromatic image, either in response to a power-on operation of said image formation device or in response to attachment of each toner cartridges; and a control module that, when said specification module specifies formation of the composite color image, controls to selectively apply a color image adjustment operation for toner density adjustment that adjusts a toner density of each toner image formed, while controlling to selectively apply a monochromatic image adjustment operation for the toner density adjustment when said specification module specifies formation of the monochromatic image.

* * * * *